US009362671B2

(12) United States Patent
Vaccaro

(10) Patent No.: US 9,362,671 B2
(45) Date of Patent: Jun. 7, 2016

(54) COAXIAL CABLE CONNECTOR WITH QUICK-LOCKING CONNECTION

(71) Applicant: CommScope Technologies LLC, Hickory, NC (US)

(72) Inventor: Ronald A. Vaccaro, Shorewood, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/445,581

(22) Filed: Jul. 29, 2014

(65) Prior Publication Data

US 2015/0064952 A1 Mar. 5, 2015

Related U.S. Application Data

(60) Provisional application No. 61/870,871, filed on Aug. 28, 2013.

(51) Int. Cl.

| | |
|---|---|
| ***H01R 13/639*** | (2006.01) |
| ***H01R 9/05*** | (2006.01) |
| ***H01R 13/622*** | (2006.01) |
| ***H01R 103/00*** | (2006.01) |
| ***H01R 13/625*** | (2006.01) |

(52) U.S. Cl.

CPC ..... *H01R 13/639* (2013.01); *H01R 9/0521* (2013.01); *H01R 13/622* (2013.01); *H01R 13/625* (2013.01); *H01R 2103/00* (2013.01)

(58) Field of Classification Search

CPC .. H01R 13/622; H01R 13/639; H01R 13/621; H01R 9/05; H01R 9/0521; H01R 13/625

USPC ..... 439/321, 286, 311, 316, 340–380, 644, 439/671

See application file for complete search history.

(56) References Cited

U.S. PATENT DOCUMENTS

| | | | | |
|---|---|---|---|---|
| 2,728,895 | A * | 12/1955 | Quackenbush et al. | 439/321 |
| 4,690,494 | A * | 9/1987 | Hirose et al. | 385/60 |
| 6,267,612 | B1 * | 7/2001 | Arcykiewicz et al. | 439/253 |
| 6,619,876 | B2 * | 9/2003 | Vaitkus et al. | 403/349 |
| 6,709,289 | B2 | 3/2004 | Huber et al. | |
| 7,032,931 | B2 * | 4/2006 | Austin | 285/92 |
| 7,850,472 | B2 * | 12/2010 | Friedrich et al. | 439/256 |
| 7,914,311 | B1 * | 3/2011 | Gallusser et al. | 439/321 |
| 8,408,938 | B2 * | 4/2013 | Proeckl | 439/439 |
| 2011/0130048 | A1 | 6/2011 | Haunberger et al. | |

* cited by examiner

*Primary Examiner* — James Harvey
*Assistant Examiner* — Oscar C Jimenez
(74) *Attorney, Agent, or Firm* — Myers Bigel & Sibley, P.A.

(57) ABSTRACT

A coaxial cable plug includes: an inner conductor extension configured to mate with the inner conductor extension of a mating coaxial cable jack; an outer conductor extension configured to mate with the outer conductor extension of the mating coaxial cable jack; a coupling nut positioned radially outwardly of the outer conductor extension of the coaxial cable plug and having an internal cavity; and a thread-engaging member residing within the internal cavity of the coupling nut. The thread-engaging member includes radially-inwardly extending projections configured to intermesh with outer threads of a housing of the mating coaxial cable jack and is movable relative to the coupling nut. Rotation of the coupling nut relative to the outer threads of the housing of the mating coaxial cable jack causes the projections of the thread-engaging member to move relative to the threads of the jack housing, thereby securing the jack to the plug.

13 Claims, 5 Drawing Sheets

COAXIAL CABLE CONNECTOR WITH QUICK-LOCKING CONNECTION

RELATED APPLICATION

The present application claims the benefit of and priority from U.S. Provisional Patent Application No. 61/870,871, filed Aug. 28, 2013, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

"Quick-connect" coaxial connectors rely on a mechanism for maintaining contact between mated conductors that eliminates the multiple rotations of a threaded coupling nut. However, such connectors may suffer from unreliable performance due to inconsistent contact between conductors of the connectors. In addition, many quick-connect coaxial connectors are configured such that they may only be connected to specific mating quick-connect connectors; thus, they are unable to be used with some standard connectors that may already be in the field. It may be desirable to provide a reliable quick-connect coaxial connector configuration, and in particular one that can connect to some existing standard connectors.

SUMMARY

As a first aspect, embodiments of the invention are directed to a coaxial cable plug. The plug comprises: an inner conductor extension configured to mate with the inner conductor extension of a mating coaxial cable jack; an outer conductor extension configured to mate with the outer conductor extension of the mating coaxial cable jack; a coupling nut positioned radially outwardly of the outer conductor extension of the coaxial cable plug and having an internal cavity; and a thread-engaging member residing within the internal cavity of the coupling nut. The thread-engaging member includes radially-inwardly extending projections configured to intermesh with outer threads of a housing of the mating coaxial cable jack and is movable relative to the coupling nut. Rotation of the coupling nut relative to the outer threads of the housing of the mating coaxial cable jack causes the projections of the thread-engaging member to move relative to the threads of the jack housing, thereby securing the jack to the plug.

As a second aspect, embodiments of the invention are directed to a coaxial connector assembly comprising a coaxial cable jack having a housing with external threads and a coaxial cable plug. The plug comprises: an inner conductor extension configured to mate with an inner conductor extension of the coaxial cable jack; an outer conductor extension configured to mate with an outer conductor extension of the coaxial cable jack; a coupling nut positioned radially outwardly of the outer conductor extension of the coaxial cable plug; and a thread-engaging member positioned between the external threads of the coaxial cable jack housing and the coupling nut. The thread-engaging member includes radially-inwardly extending projections configured to intermesh with the external threads the housing of the mating coaxial cable jack and is movable relative to the coupling nut. Rotation of the coupling nut relative to the external threads of the housing causes the projections of the thread-engaging member to move relative to the external threads of the housing, thereby securing the jack to the plug.

As a third aspect, embodiments of the invention are directed to a coaxial connector assembly comprising a coaxial cable jack having a housing with external threads and a coaxial cable plug. The plug comprises: an inner conductor extension configured to mate with an inner conductor extension of the coaxial cable jack; an outer conductor extension configured to mate with an outer conductor extension of the coaxial cable jack; a coupling nut positioned radially outwardly of the outer conductor extension of the coaxial cable plug; and a thread-engaging member positioned between the external threads of the coaxial cable jack housing and the coupling nut. The thread-engaging member includes radially-inwardly extending projections configured to intermesh with the external threads the housing of the mating coaxial cable jack and is movable relative to the coupling nut. Rotation of the coupling nut relative to the external threads of the housing causes the coupling nut to move toward the coaxial cable jack along an axis parallel to the housing and the projections of the thread-engaging member to engage the external threads of the housing, thereby securing the jack to the plug.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
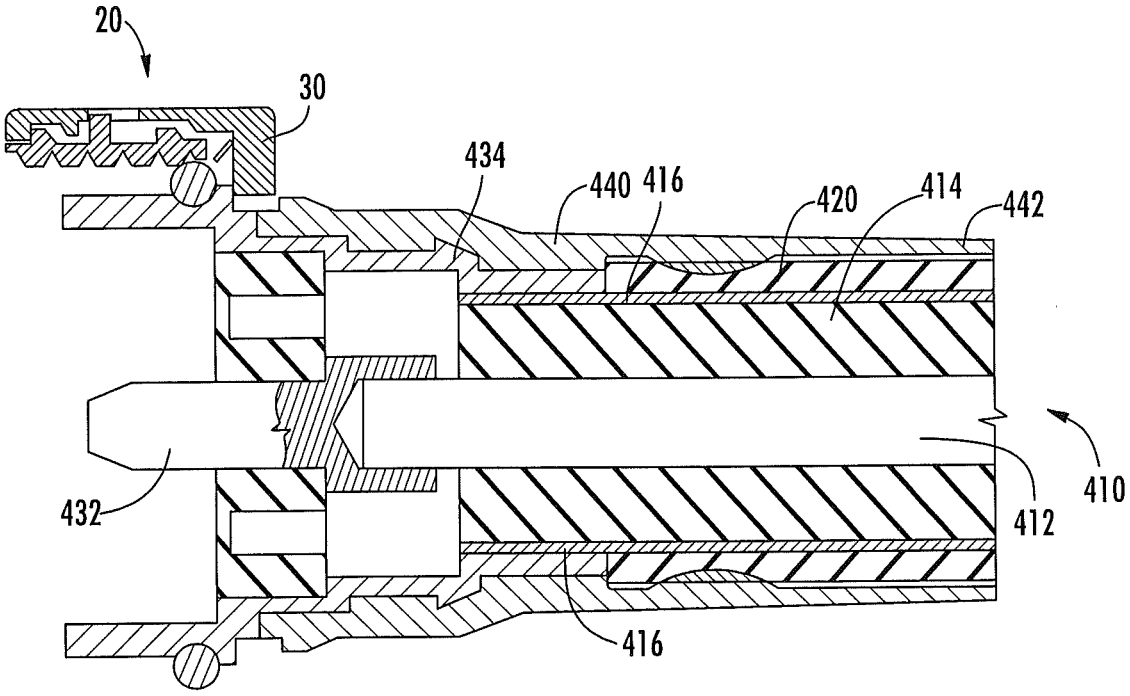
FIG. 1 is a partial cross-section of a coaxial cable-connector assembly according to embodiments of the present invention.
Figure 2:
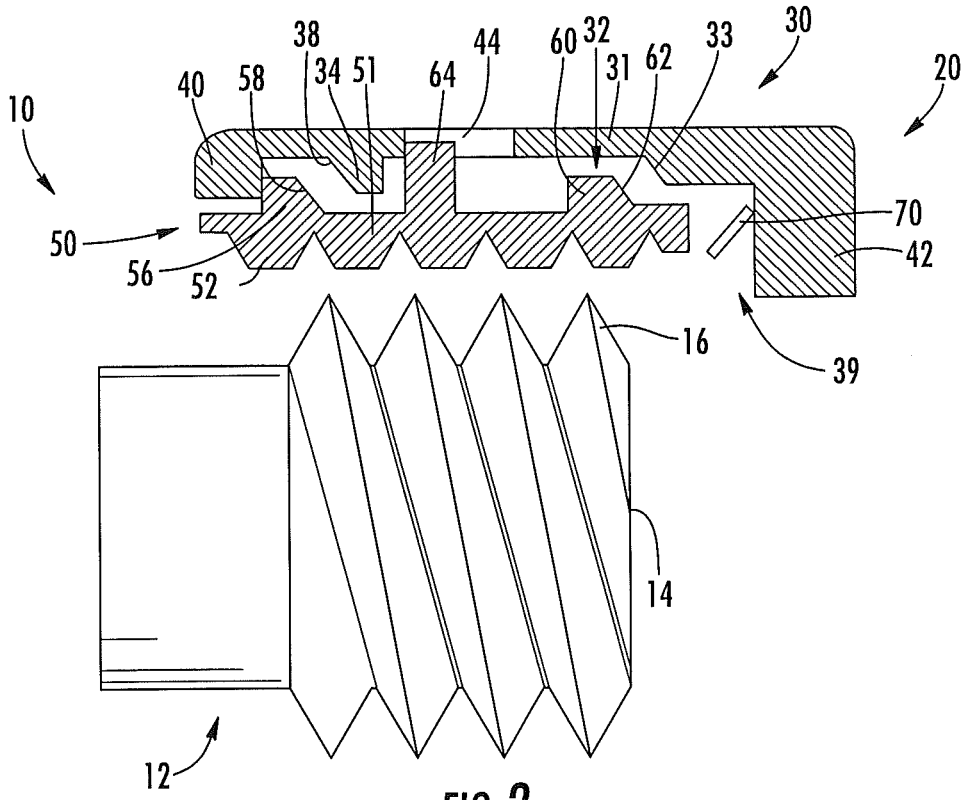
FIG. 2 is a partial cross-section of a mated coaxial plug jack assembly according to embodiments of the present invention, with the coupling nut and flex member of the plug in an unsecured position.
Figure 3:
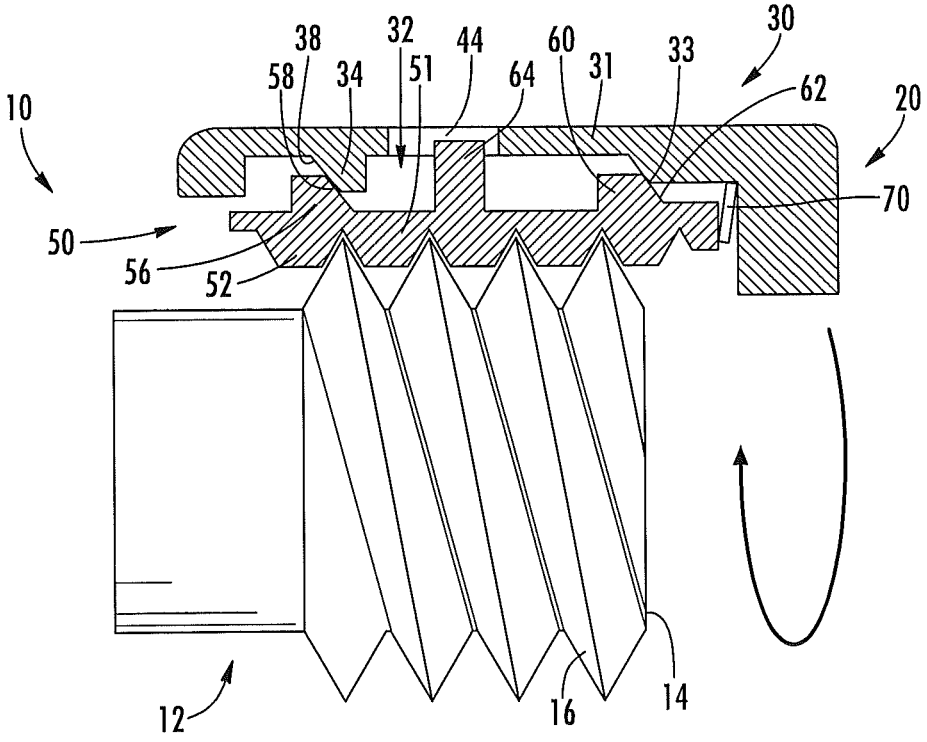
FIG. 3 is a partial cross-section of the coaxial plug-jack assembly of FIG. 2, with the coupling nut and flex member in a secured position.

FIG. 1 illustrates a coaxial cable, designated broadly at 410, and a plug, designated broadly at 20, according to embodiments of the present invention. The cable 410 includes a central conductor 412, a dielectric layer 414 that circumferentially overlies the central conductor 412, an outer conductor 416 that circumferentially overlies the dielectric layer 414, and a polymeric cable jacket 420 that circumferentially overlies the outer conductor 416. These components will be well-known to those of skill in this art and need not be described in detail herein. FIG. 1 illustrates schematically that the outer conductor 416 may be of a smooth profile; alternatively, the outer conductor of the cable may have a corrugated, braided or foil profile. Both of these outer conductor configurations are known to those of skill in this art and need not be described in detail herein.

Referring again to FIG. 1, attachment of the cable 410 to the plug 20 enables the cable 410 to be connected with a jack of a mating coaxial cable. The plug 20 includes a central conductor extension 432, an outer conductor extension 434, a coupling nut 30, and an overmold body 440. The central conductor extension 432 and the outer conductor extension 434 are configured to mate at their free ends (i.e., the ends on the left side of FIG. 1) with the respective conductors of a mating coaxial cable jack (not shown). One exemplary configuration for the central and outer conductor extensions 432, 434 is a 7/16 DIN connection, although other configurations, such as Type-N and 4.3/10 DIN, may also be employed.

FIGS. 2-5 illustrate an assembly 10 of a coaxial cable jack 12 and the coaxial cable plug 20. The jack 12 may be attached to a coaxial cable (not shown) or may comprise a connector port on, for example, a piece of electrical equipment, and is of conventional construction; it includes a threaded housing 14 (typically formed of a metal such as brass) with outer threads 16. The housing 14 surrounds an inner contact and either serves as or surrounds an outer contact that are electrically connected to the inner and outer conductors of the coaxial cable and that are configured to mate with the inner and outer conductor extensions 432, 434 of the plug 20. The jack 12 may be of any size known to those skilled in this art; exemplary configurations include the standard type N, TNC and 7/16 DIN jacks.

Still referring to FIGS. 2-5, as with many conventional plugs, the plug 20 includes the coupling nut 30 to secure the plug 20 to the jack 12; however, in illustrated embodiment, the plug 20 also includes a flex member 50 and a spring 70. The structure and use of these will be described in detail below.

The coupling nut 30 has a generally cylindrical main body 31 that defines an inner cavity 39. The main body 31 has a recess 32 in its inner surface. A bevelled face 33 is located at the rear end of the recess 32 (i.e., the end of the recess nearest the cable 410). A protrusion 34 extends radially inwardly from a forward portion of the recess 32; the protrusion 34 has a forwardly-facing bevelled face 38. A front shoulder 40 defines the forward end of the recess 32. A rear flange 42 extends radially inwardly from the rear end of the main body 31.

Figure 4:
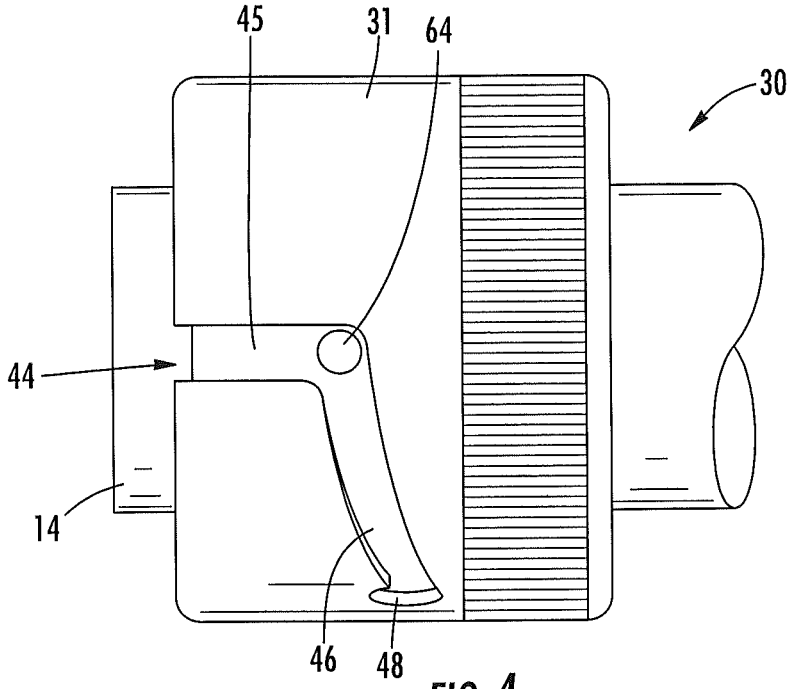
FIG. 4 is a top view of the coaxial plug-jack assembly of FIG. 2, with the coupling nut and flex member in their unsecured position.
Figure 5:
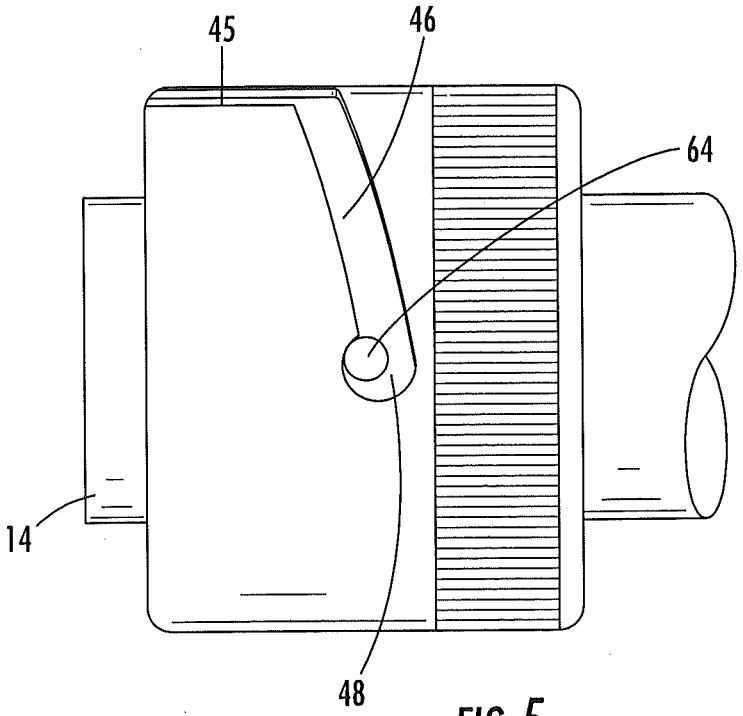
FIG. 5 is a top view of the coaxial plug-jack assembly of FIG. 2, with the coupling nut and flex member in their secured position.

Best seen in FIGS. 4 and 5, the coupling nut 30 includes a slot 44. The slot 44 has an axial segment 45 extending rearwardly (i.e., toward the cable 410) from the front edge of the coupling nut 30 and an angled segment 46 that extends circumferentially and slightly rearwardly from the rear end of the axial segment 45. A detent 48 is located at the end of the angled segment 46.

The coupling nut 30 is typically formed of a metallic material. An exemplary material for the coupling nut 30 is brass, although other materials may also be employed.

Referring back to FIGS. 2 and 3, the flex member 50 has a generally cylindrical main body 51, but includes a longitudinal slot (not shown) that enables the flex member 50 to be flexed easily in the radial direction. Inner threads 52 are present in the interior of the flex member 50 and may be truncated (as illustrated herein) in a manner known to those of skill in this art. A front nub 56 extends radially outwardly from a front portion of the main body 51 and includes a rearwardly-facing bevelled surface 58; similarly, a rear nub 60 extends radially outwardly from a rear portion of the main body 51 and includes a rearwardly-facing bevelled surface 62. A bayonet 64 extends radially outwardly from a central portion of the main body 51.

Like the coupling nut 30, the flex member 50 is typically formed of a metallic material. An exemplary material for the flex member 50 is brass, although other materials may also be employed.

As can be seen in FIGS. 2-5, the flex member 50 resides radially inwardly from the coupling nut 30 within the cavity 39, with the front nub 56 positioned between the front shoulder 40 and the bevelled face 38 of the coupling nut 30, the bayonet 64 positioned within the slot 44 of the coupling nut 30 (typically at or near the vertex between the axial and angled segments 45, 46, as shown in FIG. 4), and the rear nub 60 positioned in front of the bevelled face 33 of the coupling nut 30. The flex member 50 is biased forwardly by the spring 70, which is typically a washer-type spring or the like; when forwardly biased, the flex member 50 is located such that the front face of the front nub 56 contacts the front shoulder 40 of the coupling nut 30 (see FIG. 2).

When the plug 20 is to be connected with the jack 12, these two components are brought together such that central and outer conductor extensions 432, 434 of the plug 20 mate with corresponding structures in the jack 12, with the threaded housing 14 being received within the space radially inward of the flex member 50. Because the inner threads 52 are truncated, and because the flex member 50 can expand/contract radially due to the presence of the longitudinal slot, the plug 20 can receive the housing 14 until it "bottoms out" by contacting the reference plane provided by the plug 20. In some embodiments, the passage of the inner threads 52 over the outer threads 16 will provide a "zipping" sound and tactile sensation.

As the housing 14 of the jack 12 bottoms out, the inner threads 52 of the flex member 50 intermesh with the outer threads 16 of the housing 14, and the bayonet 64 is located at the vertex of the axial and angled segments 45, 46 of the slot 44 (see FIG. 4). The coupling nut 30 is then rotated about the longitudinal axis of the housing 14, with the slot 44 moving relative to the bayonet 64 captured therein. The path defined by the angled segment 46 of the slot 44 forces the coupling nut 30 forwardly as the coupling nut 30 rotates (see FIG. 4). Forward movement of the coupling nut 30 draws the bevelled faces 34, 38 of the coupling plug 30 into the bevelled surfaces 58, 62 of the front and rear nubs 56, 60 of the flex member 50. This interaction compresses the flex member 50 radially inwardly (see FIG. 3) to secure and/or tightening the connection between the jack 12 and the plug 20. Twisting of the coupling nut 30 ceases (typically after ¼ or ¼ rotation or so) when the bayonet 64 reaches the detent 48 of the slot 44, where it "locks" into place (see FIG. 5). This action may be accompanied by a tactile and/or audible "click" to alert the operator that rotation and securing of the connection is complete.

As can be understood based on the foregoing, the employment of the flex member 50 and the coupling nut 30 can enable a quick-connect plug 20 to connect to a standard coaxial jack 12 without modification to either connector. Moreover, the ability to connect the plug 20 to the jack 12 simply and easily may facilitate making connections in locations that are difficult to reach with a tightening tool.

Figure 6:
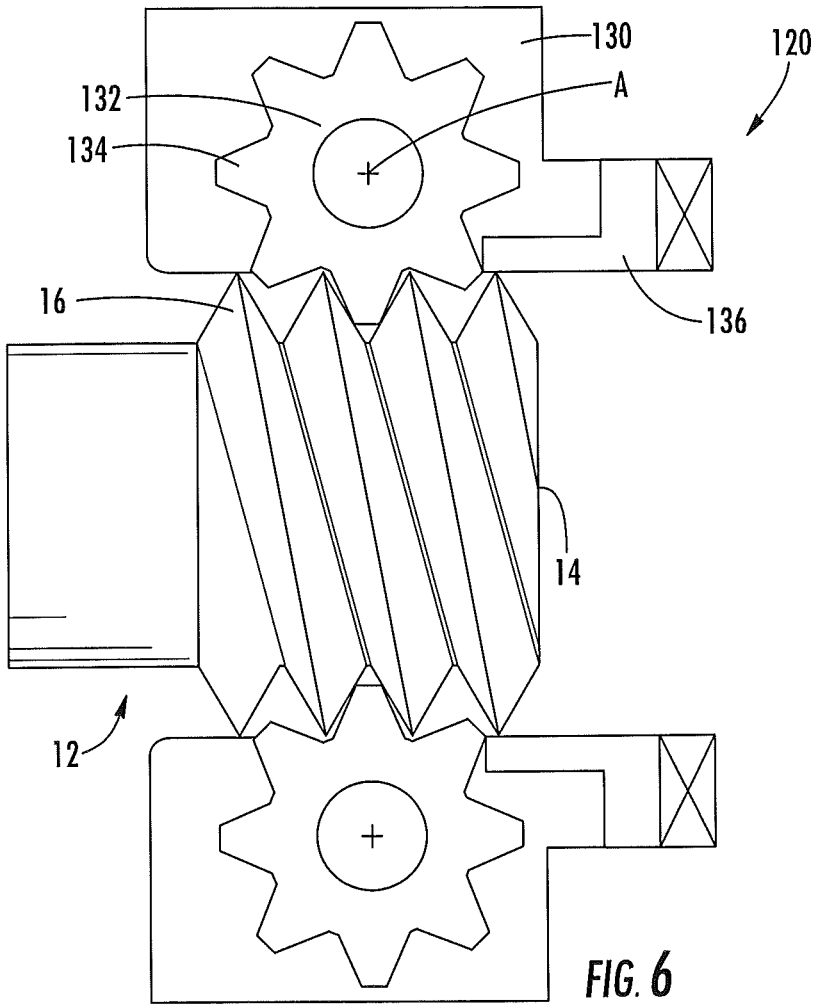
FIG. 6 is a partial cross-section of a coaxial cable-connector assembly according to alternative embodiments of the present invention.
Figure 7:
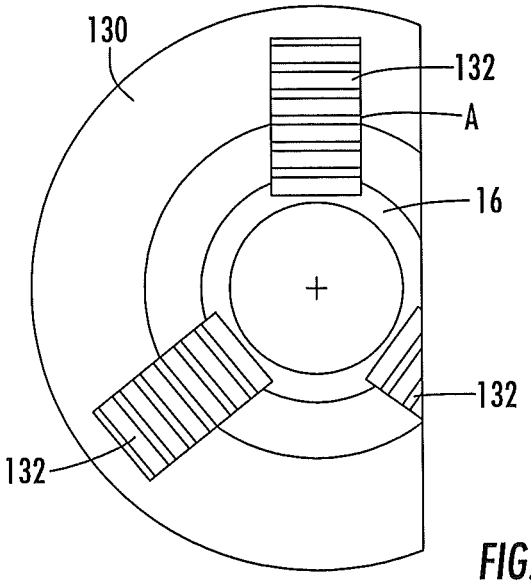
FIG. 7 is an end view of the coupling nut and gears of the coaxial cable-connector assembly of FIG. 6.

Referring now to FIGS. 6 and 7, another embodiment of a quick-locking plug, designated broadly at 120, is shown therein. The plug 120 has a coupling nut 130 that employs three gears 132 with teeth 134 that are configured to intermesh with the outer threads 16 of the housing 14 of the jack 12. Each of the gears 132 is pivotally mounted to the coupling nut 130 about an axis A that is normal to the axis of the housing 14. A ratchet spring 136 corresponding to each gear 132 is mounted on the coupling nut 130 rearwardly of the gear 132.

In operation, the plug 120 is inserted onto the housing 14 of the jack 12 until the housing 14 "bottoms out" relative to the plug 120. The coupling nut 130 may then be rotated relative to the jack 12 about the axis of the housing 14. This relative rotation causes the gears 132 to rotate (counterclockwise in the case of the gear 132 in FIG. 6) due to the interaction between the outer threads 16 of the housing 14 and the teeth 134 of the gears 132. The gears 132 are prevented from rotating in the opposite direction (i.e., clockwise in FIG. 5) by the ratchet spring 136. The ratchet spring 136 also provides an audible and tactile "click" that can signal the operator that a complete connection has been achieved.

Figure 8:
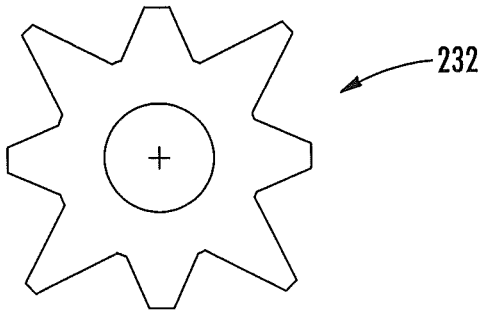
FIG. 8 is a side view of an alternative gear for the coaxial cable-connector assembly of FIG. 6.
Figure 9:
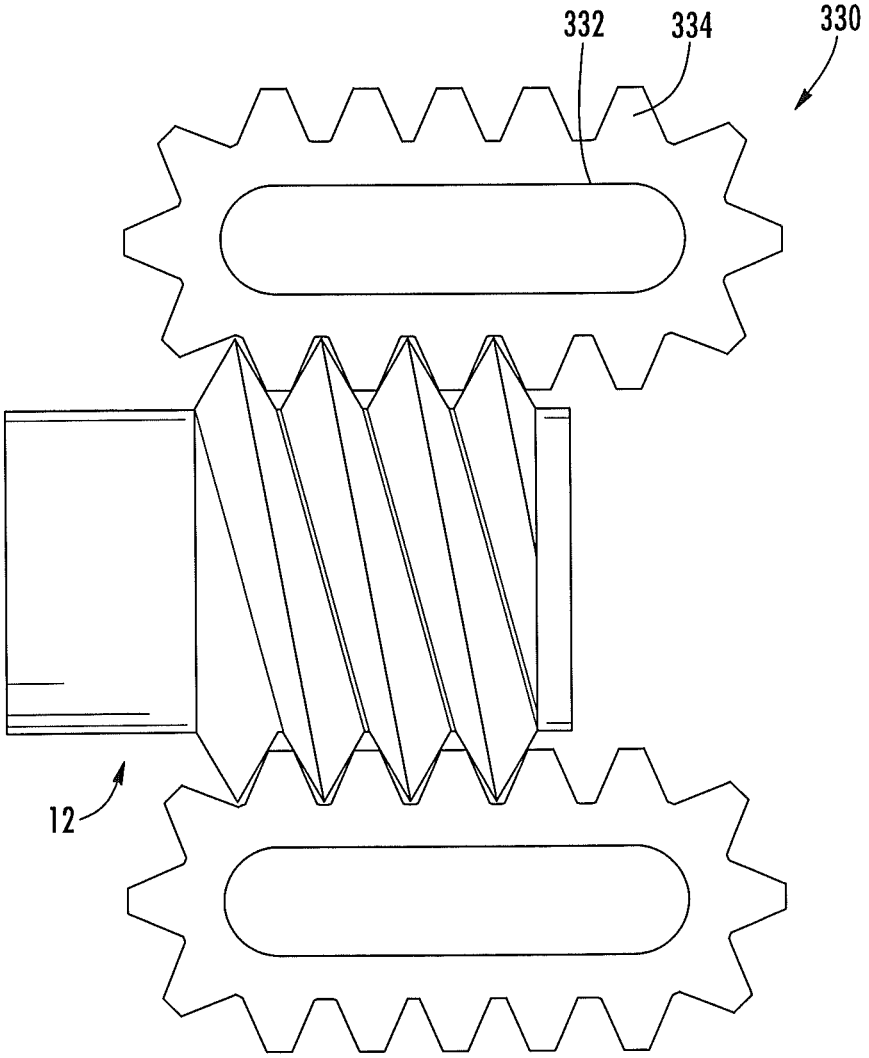
FIG. 9 is a partial cross-section of another coaxial cable-connector assembly according to alternative embodiments of the present invention.

Alternative embodiments to the plug 120 are shown in FIGS. 8 and 9. FIG. 8 illustrates a generally "square" gear 232 that may operate in much the same fashion as the round gear 132 of FIGS. 6 and 7; however, the square profile of the gear 232 may eliminate the need for the ratchet spring 134 in order to prevent counter-rotation of the gear 232 (once the square gear 232 has rotated past one of its "corners", the geometry of gear 232 biases the gear 232 against counter-rotation). Those skilled in this art will appreciate that the gear 232 could also take another shape, such as oval, rectangular, elliptical, or the like.

FIG. 9 illustrates a coupling nut 330 with an endless toothed belt 332 having teeth 334 that would replace the gear 132 of FIGS. 6 and 7. The belt 332 rotates counterclockwise (from the vantage point of FIG. 9) when the coupling nut 330 is rotated relative to the jack 12; counter-rotation is prevented by a ratchet spring such as that shown in FIG. 6. One potential advantage of this arrangement is the relatively small radial space needed for the belt 332 compared to the gears 132, 232.

Those skilled in this art will appreciate that other configurations may also be employed. For example, thread-engaging members with radially-inwardly extending projections that intermesh with the threads of the jack housing 12 other than threaded flex members and toothed gears and belts shown herein) may also be employed. Such a thread-engaging member should be movable relative to the coupling nut so that rotation of the coupling nut causes the projections to move relative to the threads of the housing of the jack, thereby securing the jack relative to the plug.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable plug, comprising:

an inner conductor extension configured to mate with an inner conductor extension of a mating coaxial cable jack;

an outer conductor extension configured to mate with an outer conductor extension of the mating coaxial cable jack;

a coupling nut positioned radially outwardly of the outer conductor extension of the coaxial cable plug and having an internal cavity; and a thread-engaging member residing within the internal cavity of the coupling nut, the thread-engaging member including radially-inwardly extending projections configured to intermesh with outer threads of a housing of the mating coaxial cable jack, the thread-engaging member being movable relative to the coupling nut;

wherein rotation of the coupling nut relative to the outer threads of the housing of the mating coaxial cable jack causes the projections of the thread-engaging member to move relative to the threads of the jack housing, thereby securing the jack to the plug;

wherein the thread-engaging member comprises a flex member configured to at least partially circumferentially surround the housing of the mating coaxial jack, wherein the flex member includes a bayonet, the coupling nut including a slot that receives the bayonet, and wherein rotation of the coupling nut relative to the flex member compresses the projections of the flex member into the threads of the housing.

2. The coaxial cable plug defined in claim 1, wherein the coupling nut includes a first beveled face, the flex member includes a second beveled face, and rotation of the coupling nut forces the first and second beveled faces into contact with each other.

3. The coaxial cable plug defined in claim 1, further comprising a spring that biases the thread-engaging member toward the mating coaxial cable jack.

4. A coaxial connector assembly, comprising:

a coaxial cable jack having a housing with external threads; and a coaxial cable plug, comprising:

an inner conductor extension configured to mate with an inner conductor extension of the coaxial cable jack;

an outer conductor extension configured to mate with an outer conductor extension of the coaxial cable jack;

a coupling nut positioned radially outwardly of the outer conductor extension of the coaxial cable plug; and a thread-engaging member positioned between the external threads of the coaxial cable jack housing and the coupling nut, the thread-engaging member including radially-inwardly extending projections configured to intermesh with the external threads the housing of the mating coaxial cable jack, the thread-engaging member being movable relative to the coupling nut;

wherein rotation of the coupling nut relative to the external threads of the housing causes the projections of the thread-engaging member to move relative to the external threads of the housing, thereby securing the jack to the plug;

wherein the thread-engaging member comprises a flex member configured to at least partially circumferentially surround the housing of the mating coaxial jack, wherein the flex member includes a bayonet, the coupling nut including a slot that receives the bayonet, and wherein rotation of the coupling nut relative to the flex member compresses the projections of the flex member into the threads of the housing.

5. The assembly defined in claim 4, wherein the coupling nut includes a first beveled face, the flex member includes a second beveled face, and rotation of the coupling nut forces the first and second beveled faces into contact with each other.

6. The assembly defined in claim 4, further comprising a spring that biases the thread-engaging member toward the mating coaxial cable jack.

7. The assembly defined in claim 4, wherein the coaxial cable jack is mounted on a piece of electrical equipment and comprises a connector port thereon.

8. A coaxial connector assembly, comprising:

a coaxial cable jack having a housing with external threads; and a coaxial cable plug, comprising:

an inner conductor extension configured to mate with an inner conductor extension of the coaxial cable jack;

an outer conductor extension configured to mate with an outer conductor extension of the coaxial cable jack;

a coupling nut positioned radially outwardly of the outer conductor extension of the coaxial cable plug; and a thread-engaging member positioned between the external threads of the coaxial cable jack housing and the coupling nut, the thread-engaging member including radially-inwardly extending projections configured to intermesh with the external threads the housing of the mating coaxial cable jack, the thread-engaging member being movable relative to the coupling nut;

wherein rotation of the coupling nut relative to the external threads of the housing causes the coupling nut to move toward the coaxial cable jack along an axis parallel to the housing and the projections of the thread-engaging member to engage the external threads of the housing, thereby securing the jack to the plug; and wherein the thread-engaging member is a toothed gear pivotally mounted to the coupling nut, and wherein rotation of the coupling nut causes the ear to rotate relative to the coupling nut and the threads of the housing.

9. The assembly defined in claim 8, wherein rotation of the coupling nut relative to the thread-engaging member compresses the projections of the thread engaging member into the external threads of the housing.

10. The assembly defined in claim 9, wherein the thread-engaging member comprises a flex member configured to at least partially circumferentially surround the housing.

11. A coaxial cable plug, comprising:

an inner conductor extension configured to mate with an inner conductor extension of a mating coaxial cable jack;

an outer conductor extension configured to mate with an outer conductor extension of the mating coaxial cable jack;

a coupling nut positioned radially outwardly of the outer conductor extension of the coaxial cable plug and having an internal cavity; and a thread-engaging member residing within the internal cavity of the coupling nut, the thread-engaging member including radially-inwardly extending projections configured to intermesh with outer threads of a housing of the mating coaxial cable jack, the thread-engaging member being movable relative to the coupling nut;

wherein rotation of the coupling nut relative to the outer threads of the housing of the mating coaxial cable jack causes the projections of the thread-engaging member to move relative to the threads of the jack housing, thereby securing the jack to the plug;

wherein the thread-engaging member is a toothed gear pivotally mounted to the coupling nut, and wherein rotation of the coupling nut causes the gear to rotate relative to the coupling nut and the threads of the housing.

12. The coaxial cable plug defined in claim 11, wherein the gear has a generally square shape.

13. The coaxial cable plug defined in claim 11, further comprising a ratchet spring mounted to the coupling nut and positioned to prevent counter-rotation of the gear relative to the coupling nut.

* * * * *